United States Patent [19]

Thoma et al.

[11] 4,375,274

[45] Mar. 1, 1983

[54] CHOKE PIN NOZZLE

[75] Inventors: Frank Thoma, Stuttgart; Kurt Obländer, Kernen, both of Fed. Rep. of Germany

[73] Assignee: Daimler-Benz Aktiengesellschaft, Stuttgart, Fed. Rep. of Germany

[21] Appl. No.: 172,682

[22] Filed: Jul. 28, 1980

[30] Foreign Application Priority Data

Jul. 28, 1979 [DE] Fed. Rep. of Germany ..... 2930716

[51] Int. Cl.[3] ..... B05B 15/02

[52] U.S. Cl. ..... 239/117; 239/453; 239/456; 239/533.9; 239/533.12

[58] Field of Search ..... 239/117, 533.3–533.12, 239/584, 452, 453, 456, 457, 459

[56] References Cited

U.S. PATENT DOCUMENTS

| | | | |
|---|---|---|---|
| 2,595,639 | 5/1952 | Chmura et al. | 239/533.3 |
| 2,951,647 | 9/1960 | Dreisin | 239/453 |
| 3,387,790 | 6/1968 | De Luca | 239/453 |
| 3,434,667 | 3/1969 | Chmura | 239/453 |
| 3,669,360 | 6/1972 | Knight | 239/533.5 |
| 4,200,237 | 4/1980 | Urlaub et al. | 239/533.12 |
| 4,261,513 | 4/1981 | Andrews | 239/533.8 |

FOREIGN PATENT DOCUMENTS

| | | | |
|---|---|---|---|
| 879936 | 4/1953 | Fed. Rep. of Germany | 239/533.8 |
| 609514 | 5/1956 | Fed. Rep. of Germany | 239/584 |
| 1026572 | 3/1958 | Fed. Rep. of Germany | 239/533.8 |
| 2809414 | 9/1979 | Fed. Rep. of Germany | 239/533.3 |

*Primary Examiner*—James B. Marbert
*Assistant Examiner*—Michael J. Forman
*Attorney, Agent, or Firm*—Paul M. Craig, Jr.

[57] ABSTRACT

A choke pin nozzle for diesel engines in which the choke pin is arranged on a nozzle needle. The nozzle needle is axially guided in a fitted bore in a nozzle body and is braced, through a separate spring plate, on a helicoidal compression spring disposed in a spring chamber or cavity of the nozzle. The spring plate is formed as a component of an intermediate piston which is connected on the nozzle side and guided axially with a seal in a portion of the nozzle. An escape or discharge bore is provided in the intermediate nozzle with the bore opening into the spring cavity. The piston is of a smaller diameter than the nozzle needle. The intermediate piston includes a bearing face which is cooperable with an upper sealing surface of the nozzle needle. A guide bore of the intermediate piston is widened in a stroke zone of the bearing face at least to a diameter of the fitted bore in which the nozzle needle is axially guided.

10 Claims, 2 Drawing Figures

CHOKE PIN NOZZLE

Figure 1:
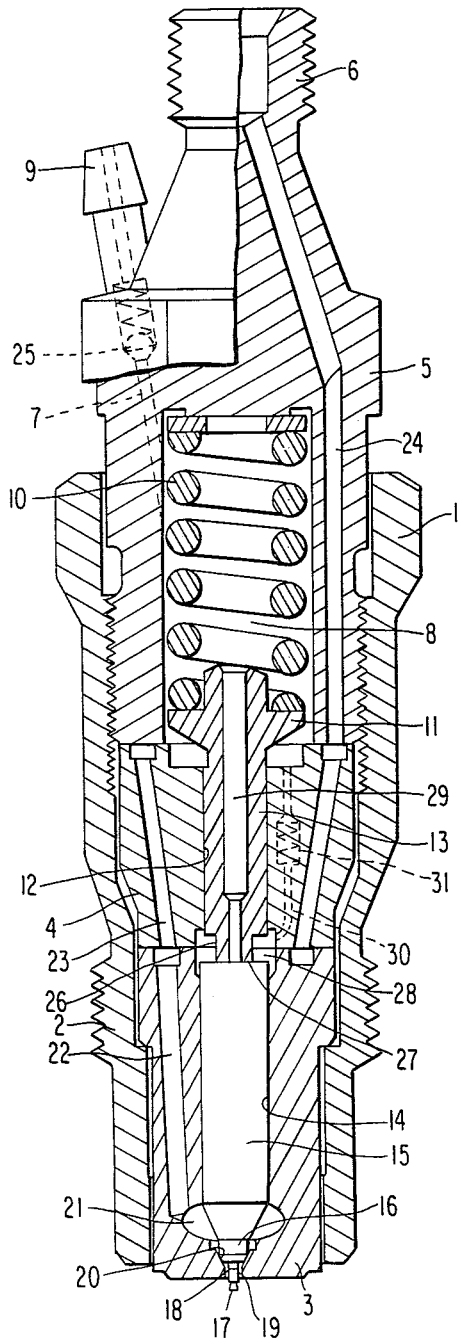

The present invention relates to a nozzle and, more particularly, to a choke pin nozzle for diesel engines, which nozzle includes a nozzle needle having a choke pin axially guided in a fitted bore provided in a nozzle body, with the choke pin being braced through a separate spring plate on a helicoidal compression spring disposed in a spring cavity or chamber of the nozzle.

In choke pin nozzles of the aforementioned type, the choke pin still penetrates through the nozzle aperture in a first phase of lifting of the needle first to control the course of injection at the start of the injection process. Since a width of the annular gap between the choke pin and the nozzle aperture is only of the order of a magnitude of 10 to 20$\mu$, a disadvantage of such type of nozzles resides in the fact that an inner surface of the annular gap and the generatrixes of the choke pin become increasingly fouled with carbon during normal operation of the engine. The accumulation of fouling with carbon results in reducing the cross section of the annular gap such that the annular gap may be completely stopped or blocked by combustion residues. Such fouling and/or blocking of the annular gap leads to a deterioration of the combustion process and also has a noticeable bad effect on combustion noises.

Practical experience has also indicated that one may also count on developing of a carbon deposit along an irregular surface, which deposit will crumble in places during operation of the engine, the cause being the diesel fuel flowing out at high pressure when the nozzle is open. This deposit of carbon is disadvantageous inasmuch as an irregular control of fuel injection results during the first lifting of the nozzle needle thereby adversely affecting the configuration of the jet of fuel injected as well as the combustion process itself.

The aim underlying the present invention essentially resides in providing a choke pin nozzle for a fuel injection nozzle which enables a retention of as uniform an annular gap as possible between the choke pin and nozzle aperture around the whole choke pin even after a rather protracted operation of the engine.

In accordance with advantageous features of the present invention, a spring plate is provided which is formed as a component of an intermediate piston which is connected on the nozzle side and guided axially with a seal in a nozzle neck of the nozzle. The intermediate piston has an escape bore extending therethrough that opens into the spring cavity or chamber. The piston is of a smaller diameter than that of the nozzle needle and a guide bore of the intermediate piston is widened in a stroke zone of a bearing face that is also constructed as a sealing surface on the nozzle needle at least to a diameter of the guide bore.

By virtue of a choke pin nozzle in accordance with the above noted features of the present invention, there is an annular gap provided between the nozzle needle and the intermediate piston, around the intermediate piston, which during operation of the diesel engine with the customary high injection pressure, is filled by leaking fuel escaping along the guide bore of the nozzle needle. Since this annular gap is reduced when the needle is lifted, because of the reduced cross section on the piston side, a raising of the needle during operation of the engine has the effect that the leak fuel in the annular gap that is of invarible volume forces the intermediate piston down against the force of the compression spring of the nozzle needle until at last the compression spring again applies the intermediate piston to the needle, at the end of the stroke of the nozzle needle after the escape of the corresponding amount of leak fuel, through the escape bore of the intermediate piston into the spring cavity.

Moreover, by virtue of the present invention, a seating of the intermediate piston on the nozzle needle that persists during a subsequent backstroke of the needle into a closed position has the effect that the rotation developing from a relaxation of the helicoidal compression spring during the backstroke will be transmitted from the end that is seated on the spring plate through the intermediate piston to the nozzle needle. Since a volume of the annular gap between the needle and the intermediate piston increases in the course of the backstroke of the needle, it is no longer possible for the intermediate piston to be pushed down by the needle and the vacuum that does develop in the annular gap because of the increase in volume only has the effect that new leaking fuel will be sucked in along the guide bore of the needle into the annular gap.

As a result of the above noted operation or functioning of the construction in accordance with the present invention, the nozzle needle that is thrust or displaced during an opening stroke without any significant rotation is turned further and each return stroke by the helicoidal compression spring always in the same direction of rotation so that the nozzle needle, during the course of the engine operation, will undergo a steady stepwise rotation whereby any carbon layers that engage each other radially in the nozzle bore or on the choke pin will rub off against each other and a uniform annular gap will be retained.

In accordance with further advantageous features of the present invention, the intermediate piston is reduced to a smaller diameter at its end which is located in a stroke zone of the bearing face. Moreover, a part that guides the intermediate piston includes a separate neck disposed between the nozzle body and nozzle head that supports a connecting nipple for the nozzle conduit.

Additionally, in accordance with further features of the present invention, the spring cavity is connected or in communication with a leak connection that is also in communication with the annular gap formed in a stroke zone of a bearing face by way of the neck presented by a conduit that penetrates the guide bore for the intermediate piston. A check valve is disposed in the conduit that opens toward the annular gap.

Additionally, in accordance with the present invention, an excess pressure valve is disposed in a conduit that connects or communicates the leak connection with the spring cavity or chamber. Moreover, the choke pin may be disposed on the nozzle needle slightly off center with respect to the provided radial width of the annular gap.

Accordingly, it is an object of the present invention to provide a choke pin nozzle for diesel engines which avoids, by simple means, shortcomings and disadvantages encountered in the prior art.

Another object of the present invention resides in providing a choke pin nozzle for diesel engines which retains a uniform annular gap between the choke pin and an aperture of opening of the nozzle.

A further object of the present invention resides in providing a choke pin nozzle for diesel engines which ensures a proper configuration of the injected jet of fuel.

Yet another object of the present invention resides in providing a choke pin nozzle for diesel engines which minimizes the formation of carbon deposits on the nozzle.

A still further object of the present invention resides in providing a choke pin nozzle for diesel engines which is simple in construction and therefore relatively inexpensive to manufacture.

Another object of the present invention resides in providing a choke pin nozzle for diesel engines which functions realiably under all operating conditions of the engine.

Figure 2:
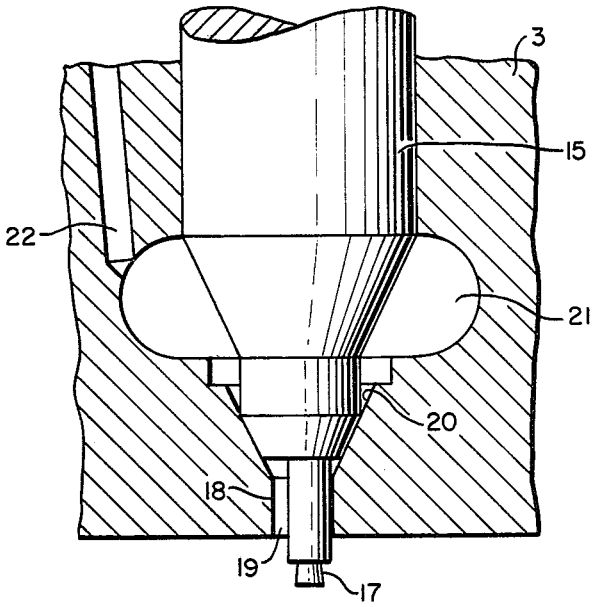

These and other objects, features, and advantages of the present invention will become more apparent from the following description when taken in connection with the accompanying drawing which shows, for the purposes of illustration only, two embodiments in accordance with the present invention, and wherein:

FIG. 1 is a cross sectional view of a choke pin nozzle in accordance with the present invention, FIG. 2 is a partial cross sectional view, on an enlarged scale, of another embodiment of a choke pin nozzle constructed in accordance with the present invention.

Referring now to the drawings wherein like reference numerals are used in both views to designate like parts and, more particularly, to FIG. 1, according to this figure, a choke pin nozzle includes a sleeve-like nozzle housing 1 provided with an external thread 2 for enabling a threading of the nozzle into a receiving bore (not shown) of an associated cylinder of a diesel internal combustion engine. A nozzle body 3 is provided on a discharge side of the nozzle housing 1 with a nozzle neck 4 adjoining the nozzle body 3. A connecting nipple 6 is provided on a connecting side of a nozzle head 5. The connecting nipple 6 enables a connection of the nozzle with a conventional injection conduit (not shown) which is interposed between the nozzle and an injection pump (not shown).

The nozzle head 5 includes a leak connection 9 for leaked fuel, with the connection 9 being connected by way of a conduit 7 with a spring cavity or chamber 8 located in the head 5. A compression spring 10 is braced or supported on a face of the connection side of the spring cavity or chamber 8. The compression spring 10 is formed as a helicoidal spring with a spring plate 11 being braced thereon. The spring plate 11 is formed as a component of an intermediate piston 13 which is axially connected and guided in an axial guide bore 12 of the nozzle neck 4. A nozzle needle 15 is braced or supported, in a conventional manner, on a free end of the intermediate piston 13. The nozzle needle 15 is disposed in an axial bore 14 provided in the nozzle body 3.

The nozzle needle 15 is tapered at a free end thereof to form a conical connecting body 16 to which is axially connected a choke pin 17. In the illustrated closed position, the choke pin 17 penetrates or extends through a bore 18 provided on a discharge side of the nozzle body 3. The bore 18 and choke pin 17 are dimensioned so that an annular gap 19 is formed between the choke pin 17 and the nozzle bore 18. A radial width of the annular gap 19 is of the magnitude of 10 to 20$\mu$.

The annular gap 19 widens in the nozzle body to a conical seat 20 for accommodating the connecting body 16 and further widens so as to form an annular chamber 21 that is connected or communicated with the connecting nipple 6 through various connecting conduits such as, for example, the conduits 22, 23 and 24 of the nozzle body 3, nozzle neck 4, and nozzle head 5. The connecting conduits 22, 23, 24 are disposed so as to be essentially axially parallel. An excess pressure valve 25 that opens toward the leak connection 9 is provided between the leak connection 9 and the conduit 7 leading from the spring cavity or chamber 8 to the leak connection 9.

As also shown in the drawing, the intermediate piston 13 has a somewhat smaller diameter than that of the nozzle needle 15 and includes a further reduction to yet a smaller diameter than that of the nozzle needle 15 in a stroke zone or area of a bearing face 27, fashioned as a sealing surface, so that an annular chamber 28 is produced thereat. The internal diameter of the annular chamber 28 that is also in the stroke zone or area of the bearing face 27 is somewhat greater than a diameter of the guide bore 14. Additionally, the intermediate piston 13 includes an axially extending discharge bore 29 that open into or communicates with the spring cavity or chamber 8. The discharge bore 29 on a needle side end is normally closed against the annular chamber 28 by the nozzle needle 15 that bears on the bearing face 27.

A conduit 30, extending essentially axially parallel to the discharge bore 20 communicates or connects the annular chamber 28 with the spring cavity or chamber 8. A check valve 31, opening toward the annular chamber 28, is disposed in the conduits 30.

The choke pin nozzle of the present invention operates in the following manner:

At the start or beginning of the injection process, the diesel fuel supplied under high pressure from the connection nipple 6 into the annular chamber 21 causes an opening movement of the nozzle needle 15 into the nozzle body 3. To the extent that the nozzle is being put into operation for the first time, the leak fuel that escapes into the annular chamber 28 because of the high injection pressure along guide bore 14 of the nozzle body 3 effects a quick complete filling of the chamber 28 whereby air that is present at first along the guide bore 12 of the nozzle neck 4 escapes toward the spring cavity or chamber 8 which is under a negligibly low pressure.

If the nozzle needle 15, at a start of a subsequent injection process, is lifted against the force of the compression spring 10 from the closed position, then because of the smaller diameter of the intermediate piston 13 with respect to the diameter of the nozzle needle 15 and the resulting reduction of the annular chamber 28, there is a lifting of the intermediate piston 13 from the nozzle needle 15 against a force of the further compression of the spring 10 so that a fuel volume corresponding to the reduction of volume escapes from the annular chamber 28 through the discharge bore 29 into the spring chamber 8.

As soon as the annular chamber 28 has attained a minimum volume and the nozzle needle is at the end of the opening stroke, the intermediate piston 13 is again pressed on the nozzle needle 15 so that a firm seat is maintained during a whole return stroke of the nozzle needle 15 into the illustrated closed position. With the resulting re-enlargement of the annular chamber 28, the leak fuel is once again drawn or sucked through the conduit 30 as well as along the guide bore 14 into the annular chamber 28 so that the chamber 28 is constantly filled with diesel fuel during further operation of the nozzle.

As evident from the above described operation of the present invention, there is the effect that the nozzle needle 15 remains without mechanical connection with the intermediate piston during the opening stroke and therefore is thrust or displaced inward only in an essentially axial direction. During an outward stroke of the nozzle needle 15, the needle 15 remains braced and fixedly applied to the intermediate piston 13 which, since it bears on the other side end of the compression spring 10 formed as a helicoidal spring, undergoes a rotation in the same direction. The result of such movement is a stepwise uniform rotation of the nozzle needle 15 with each closing stroke with a corresponding stepwise rotation in the same direction on the part of the choke pin 17 in the bore 18.

To the extent that the very narrow annular gap 19 between the nozzle bore 18 and choke pin 17 would be so reduced by a deposit of combustion residues in the bore 18 and on the pin 17 that the deposits on either side would engage each other radially, the "steady" stepwise rotation of the choke pin 17 in the bore 18 causes an opposed breaking and rubbing off of protruding deposits. Since, as a rule, unavoidable manufacturing tolerances additionally lead to a more or less off centering position of the pin 17 in the bore 18, the stepwise rotation of the choke pin 17 is further advantageous since, after a rather long operation of the diesel engine, there will remain a uniform residual ring gap around the choke pin 17.

Since it may be assumed that the leak fuel that fills the spring cavity or chamber 8 in the course of operation of the injection nozzle will be drawn through the conduit 30 into the annular chamber 28 because of the suction in the chamber 28, if desired, the excess pressure valve 25 provided in the conduit 7 may be omitted. However, a slight or low pressure must be provided in the spring cavity or chamber 8 in order to keep it completely filled with fuel. Such pressure may, for example, be delivered by the fuel pump supplying the fuel.

Moreover, since the aforementioned suction will lead to a complete filling of the annular chamber 28 by the leak fuel penetrating through the guide bore 14, the conduit 30 and check valve 31 may also for example, be eliminated. Additionally, as shown most clearly in FIG. 2 the choke pin 17 could be disposed so as to be slightly off center with respect to the width of the annular gap 19 so that, during the operational rotation of the choke pin 17 and the nozzle bore 18, there would be a specific residual gap width for the annular gap 19 between the carbon deposits.

While we have shown and described only two embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A choke pin nozzle for diesel engines, the nozzle including a nozzle housing, a nozzle body disclosed in said housing, a fitted nozzle bore provided in the nozzle body, a nozzle needle including a choke pin axially guided in the nozzle bore, a helicoidal compression spring means for urging the nozzle needle into a closed position, and a spring chamber means for accommodating the compression spring means, characterized in that an intermediate piston is disposed between the compression spring means and the nozzle needle, the nozzle body includes a guide bore means for sealingly axially guiding the intermediate piston, an axially extending bore means is provided in the intermediate piston and communicates with the spring chamber means, the intermediate piston terminates in a bearing face means adapted to sealingly cooperate with an upper surface of the nozzle needle, means are provided on the intermediate piston for enabling the intermediate piston to be displaced with respect to the nozzle needle, said guide bore means is widened in an area of a stroke zone of the intermediate piston so as to form an annular chamber, the annular chamber is in selective communication with the axially extending bore means in dependence upon a position of the bearing face means relative to the upper surface of the nozzle needle, the intermediate piston has a reduced diameter in an area of the bearing face means, the guide bore means is disposed in a separate neck portion interposed between the nozzle body and the nozzle head, the nozzle head includes a connection means enabling a connection with a nozzle conduit, a fuel leak connection means is provided and is in communication with the spring chamber means, a conduit means is provided for communicating the spring chamber means with the annular chamber, and in that a check valve means is interposed in the conduit means for controlling the flow therethrough, said check valve means opening in a direction of the annular chamber.

2. A choke pin nozzle according to claim 1, characterized in that an excess pressure valve means is disposed in a conduit communicating the leak connection means with the spring chamber means.

3. A choke pin nozzle according to claim 2, characterized in that the nozzle body terminates in a discharge bore in which the choke pin is axially displaceable, said choke pin having a diameter which is less than a diameter of an opening of the discharge bore such that an annular gap is formed around the choke pin when the choke pin is received in the discharge bore.

4. A choke pin nozzle according to claim 3, characterized in that the choke pin is arranged on a nozzle needle so as to be offset with respect to the annular gap.

5. A choke pin nozzle according to claim 1, characterized in that a spring plate means is formed as a component on an end of the intermediate piston opposite the bearing face means for supporting an end of the helicoidal compression spring means.

6. A choke pin nozzle according to claim 1, characterized in that the intermediate piston has a diameter which is less than a diameter of the nozzle needle.

7. A choke pin nozzle for diesel engines, the nozzle including a nozzle housing, a nozzle body disposed in said housing, a fitted nozzle bore provided in the nozzle body, a nozzle needle including a choke pin axially guided in the nozzle bore, a helicoidal compression spring means for urging the nozzle needle into a closed position, and a spring chamber means for accommodating the compression spring means, characterized in that an intermediate piston is disposed between the compression spring means and the nozzle needle, the nozzle body includes a guide bore means for sealingly axially guiding the intermediate piston, an axially extending bore means is provided in the intermediate piston and communicates with the spring chamber means, the intermediate piston terminates in a bearing face means adapted to sealingly cooperate with an upper surface of the nozzle needle, means are provided on the intermediate piston for enabling the intermediate piston to be displaced with respect to the nozzle needle, said guide bore means is widened in an area of a stroke zone of the intermediate piston so as to form an annular chamber, the annular chamber is in selective communication with the axially extending bore means in dependence upon a position of the bearing face means relative to the upper surface of the nozzle needle, a fuel leak connection means is provided and is in communication with the spring chamber means, a conduit means is provided for communicating the spring chamber means with the annular chamber, and in that a check valve means is interposed in the conduit means for controlling the flow therethrough, said check valve means opening in a direction of the annular chamber.

8. A choke pin nozzle according to claim 7; characterized in that the guide bore means is disposed in a separate neck portion interposed between the nozzle body and a nozzle head, and in that the nozzle head includes a connection means for enabling a connection with a nozzle conduit.

9. A choke pin nozzle according to one of claims 7 or 8, characterized in that an excess pressure valve means is disposed in a conduit communicating the leak connection means with the spring chamber means.

10. A choke pin nozzle for diesel engines, the nozzle including a nozzle housing, a nozzle body disposed in said housing, a fitted nozzle bore provided in the nozzle body, a nozzle needle including a choke pin axially guided in the nozzle bore, a helicoidal compression spring means for urging the nozzle needle into a closed position, and a spring chamber means for accommodating the compression spring means, the nozzle body terminates in a discharge bore, the choke pin is axially displaceable into and out of the discharge bore, an intermediate piston is disposed between the compression spring means and the nozzle needle, the nozzle body includes a guide bore means for sealingly axially guiding the intermediate piston, an axially extending bore means is provided in the intermediate piston and communicates with the spring chamber means, the intermediate piston terminates in a bearing face means adapted to sealingly cooperate with an upper surface of the nozzle needle, means are provided on the intermediate piston for enabling the intermediate piston to be displaced with regard to the nozzle needle, said guide bore means is widened in an area of a stroke zone of the intermediate piston so as to form an annular chamber, the annular chamber is in selective communication with the axially extending bore means in dependence upon a position of the bearing face means relative to the upper surface of the nozzle needle, said choke pin having a diameter which is less than a diameter of an opening of the discharge bore such that an annular gap is formed around the choke pin when the choke pin is received in the discharge bore, characterized in that the choke pin is arranged on a nozzle needle so as to be offset with respect to the annular gap.

* * * * *